US005760815A

United States Patent [19]

Genovese

[11] Patent Number: 5,760,815

[45] Date of Patent: Jun. 2, 1998

[54] FIBER OPTIC REGISTRATION MARK DETECTION SYSTEM FOR A COLOR REPRODUCTION DEVICE

[75] Inventor: Frank C. Genovese, Fairport, N.Y.

[73] Assignee: Xerox Corporation, Stamford, Conn.

[21] Appl. No.: 352,950

[22] Filed: Dec. 9, 1994

[51] Int. Cl.[6] ..... B41J 2/47; B41J 2/435; G11B 7/00; G11B 7/08

[52] U.S. Cl. ..... 347/234; 347/116; 250/227.28; 250/235

[58] Field of Search ..... 347/248, 234, 347/232, 115, 116; 250/227.28, 235, 236; 359/217

[56] References Cited

U.S. PATENT DOCUMENTS 4,071,754 1/1978 Roulund ..... 250/227.28

5,175,570 12/1992 Haneda et al. ..... 347/116

*Primary Examiner*—N. Le

*Assistant Examiner*—Raquel Yvette Gordon

[57] ABSTRACT

A fiber optic detection system is used in a color reproduction device to generate color image registration signals. In one embodiment a retroreflector is positioned beneath the photoreceptor belt, the retroreflector being periodically visible through holes formed in a non-image area of the belt. An optical fiber directs flux from a light source onto the photoreceptor belt and periodically illuminates the retroreflector. Light is preferentially reflected back into the fiber with a portion being coupled to a photosensor to provide a signal used for registration purposes. In another embodiment, a plurality of optical fibers are bundled together to form a trunk at the belt illumination end with two branches functioning as the light input and detecting ends. In a still further embodiment, retroreflective marks are formed directly on the surface of a photoreceptor; the several fiber optic embodiments are used to detect the formed marks.

8 Claims, 5 Drawing Sheets

FIBER OPTIC REGISTRATION MARK DETECTION SYSTEM FOR A COLOR REPRODUCTION DEVICE

BACKGROUND AND DISCLOSURE STATEMENT

The present invention relates to registration of plural color image exposures formed on a photosensitive image member and, more particularly, to a fiber optic system for detecting retroreflective registration marks formed on, or beneath, a photoreceptor belt.

High speed copiers and digital printer machines typically employ a photoreceptor belt as the imaging media since the belt can provide significantly more area to form a plurality of latent images during a single pass or revolution when compared to a machine with a photoreceptor drum as the imaging surface. In a color reproduction device, such as a color copier or printer, for example, a plurality of image exposures are formed by an imager, typically a raster output scanner (ROS) or an LED print bar, developed and transferred in precise registration to an output paper sheet in either a single or multiple pass mode, to form a composite color output image. The position of the belt during operation must be known with a high degree of precision so that the system timing control can ensure that the individual color separation images will be formed within narrowly defined boundaries on the photoreceptor surface in order that they superimpose properly when transferred to an output paper sheet. The image exposures must be coordinated with the development, transfer and paper feeding functions. Registration errors typically occur because the belt is subject to stretching, creep, and other changes in physical size, and it's rotational speed and lateral position varies in time because of servo drift as well as mechanical wear and tolerances in the drive components. These errors are manifested in the output copies which can exhibit typical symptoms of color misregistration such as color bleeding, moire banding, and/or other defects which make the output copies unsuitable.

Various techniques have been developed in the prior art to compensate for these errors. One such method is to form registration holes or perforations in unused non-image portions of the belt surface along one or both edges. The belt surface in the perforated area is illuminated with a stationary light source. As the belt moves past the light source, light passing through the perforations strikes a photodetector. The photodetector response provides timing signals used to register images on the belt in the process and cross process or scan direction, and to correct for image skew.

The light source can be a light emitting diode which is aligned with a photosensor in a horseshoe configuration as disclosed for example in U.S. Pat. No. 5,208,796. Alternatively, the exposure device used to form the latent images on the photoreceptor is used as a light source by increasing the exposure width to include the perforated area of the belt. U.S. Pat. No. 5,175,570 and 5,260,725 disclose a ROS system wherein the scanning beam is extended laterally to scan across belt apertures formed at the edges of the belt. The scanned beam is detected by a photosensor positioned in the scan path beneath the belt in alignment with the travel path of the aperture. Similarly, U.S. Pat. No. 5,278,625 discloses an LED printer configuration wherein the LED array is lengthened so as to provide a radiation source extending outside the nominal imaging area at the print bar ends, the extended radiation source being periodically detected by photosensors beneath the belt as the apertures move therepast. These prior art references are hereby incorporated by reference.

For the above-described prior art systems, the detector, typically a photosensor incorporating a solid state photodiode, is located on a remote detector circuit board which is positioned beneath the photoreceptor belt adjacent to the belt edge. The light flux striking the active photodetector area generates a photocurrent which is amplified and relayed over wire cables to a local electronics board which contains circuitry to process the detected signal and generate appropriate commands to correct any registration errors. The requirement for separate remote electrical circuit boards and the cabling and associated electrical connectors adds to the cost and complexity of the detection system of the prior art. Further, the printer environment is electrically "noisy" due to electromagnetic interference from power supplies, relays, and motor controllers, and can include a rich radio frequency spectrum generated by digital processor units.

SUMMARY OF THE INVENTION

It is therefore one object of the invention to provide a detection system for periodically detecting a registration mark at a remote location without the use of remote electronic components or circuit boards. It is another object to increase the accuracy of detection by reducing errors caused by electrical noise in the printing environment.

These and other objects are realized by using fiber optic means to direct flux, reflected from registration targets, to a photosensor.

In one embodiment, a single optical fiber is used to detect a registration target having rectroflective properties which is formed either on the belt itself or is periodically exposed to illuminating light flux passing through belt apertures as the belt moves in a process direction. The optical fiber operates in a dual mode of transmitting light flux from a source to the belt surface, and transmitting light retroreflected back into the fiber to a photodetector, where both the source and photodetector are located on a central electronic circuit board. With this arrangement, a separate remote detector circuit board is unnecessary and the wiring that provides power and signals to and from the remote board is not needed. Noise immunity is provided since the optical signals in a fiber optics system are totally insensitive to electronic "noise", and both the illuminating light and the reflected detection signal can be transmitted long distances through an electronically noisy environment without corruption. The detected light signal is delivered directly to the central electronics circuit board where it is converted to an appropriate logic level for controlling the registration correction signal. The central electronics circuit board incorporates a shielded environment for converting from light energy to noise insensitive logic.

The use of a fiber optic detection system in a laser printing system is known wherein the fibers are used to transmit start of scan signals to a central electronics board as disclosed in U.S. Pat. No. 4,071,754 and in co-pending application Ser. No. 08/217,822 whose contents are both hereby incorporated by reference. The concept of using fiber optics in conjunction with a retroreflective target is not known.

More particularly the present invention relates to a color reproduction device which includes a photoreceptor moving along a process path, an imager for forming a plurality of superimposed color-separated latent images on said photoreceptor in accord with input image data and a fiber optic detection system for providing timing signals used to register said latent images, said fiber optic detection system including:

a light source, a fiber optic means having an input end optically coupled to said light source and an output end positioned so as to emit a light flux, the fiber optic means positioned with respect to the photoreceptor so that the light flux emitted from the output end illuminates an area of the belt outside said latent images, a retroreflector target positioned so as to be periodically illuminated by said light flux emitted from said output end and a photosensor optically coupled to said input end wherein said target, when illuminated, reflects light in a preferential direction back into the output end of the fiber, a portion of said reflected light propagating along the fiber length to illuminate said photosensor to provide an output registration signal therefrom.

DESCRIPTION OF THE INVENTION

Figure 1:
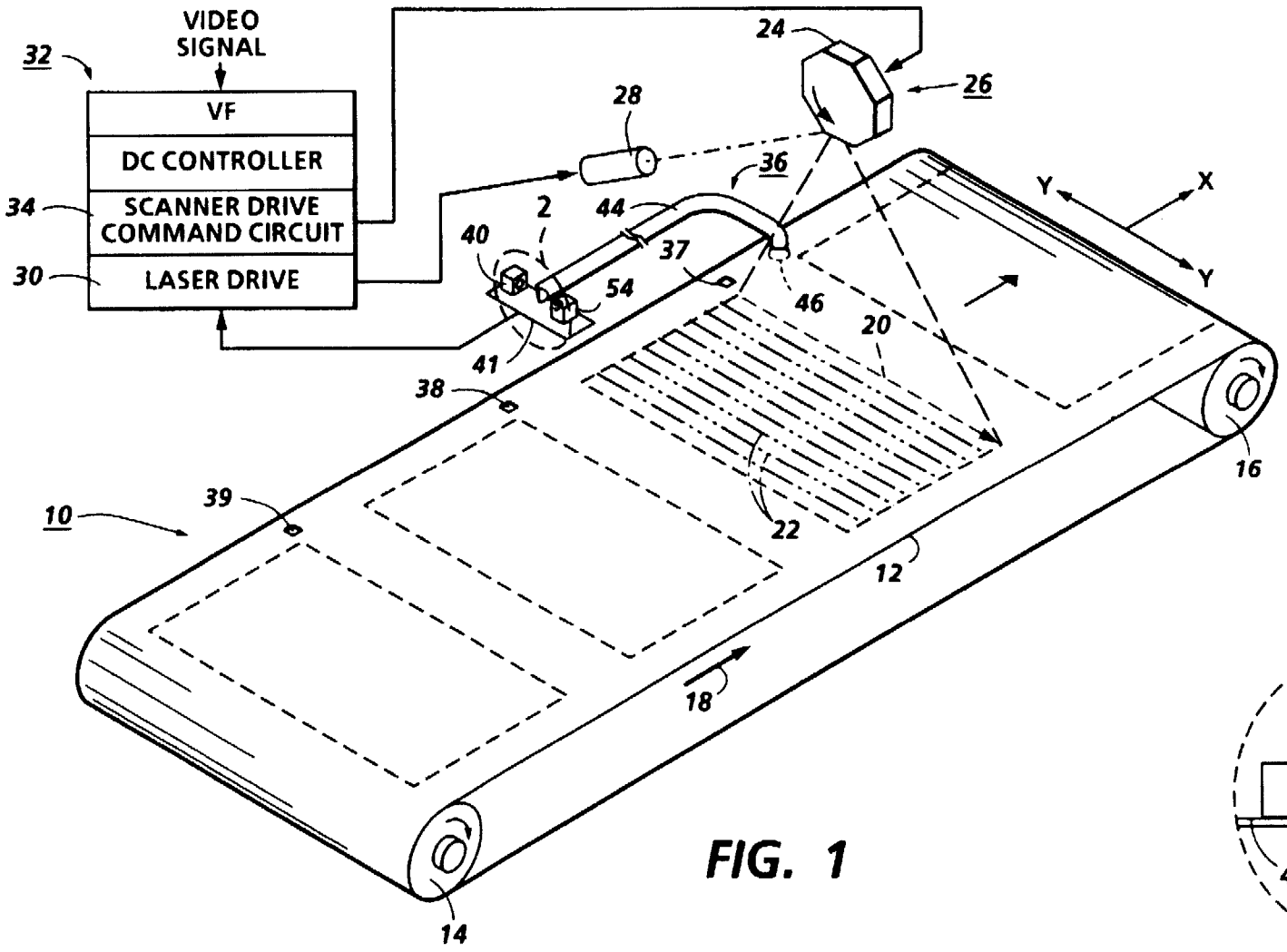
FIG. 1 is a schematic perspective view illustrating a ROS printing system and illustrating the use of an optical fiber to detect retroflective registration marks through an aperture in a photoreceptor belt.

In FIG. 1 of the drawings, an embodiment of the present invention is incorporated in a multi-pass xerographic printing system depicted schematically and designated generally by reference numeral 10. The system 10 includes a photoreceptor belt 12 trained about rollers 14 and 16, at least one of which is driven to advance the belt 12 in a longitudinal (process) direction indicated by the arrow 18. The length of the belt 12 is chosen to accept an integral number of spaced image areas represented by dashed line rectangles in FIG. 1. As each of the image areas reaches a transverse imaging line, represented by a dashed arrow 20, it is progressively exposed in a closely spaced raster of transverse lines 22 shown with exaggerated longitudinal spacing in FIG. 1.

In the embodiment of FIG. 1, the line 20 is scanned by a ROS (raster output scanner) consisting of a modulated laser beam reflected by successive facets 24 of a rotatable mirror polygon 26 and focussed on the imaging line 20. The beam is emitted by a laser source 28, such as a laser diode, operated by a laser drive 30 forming part of a control processor generally designated by the reference numeral 32. The processor 32 includes other circuit or logic modules indicated by legends in FIG. 1 and includes a scanner drive command circuit 34 by which operation of a motor (not shown) for rotating polygon 26 is controlled. It is understood that an alternate imager, such as an LED print bar, could be used to generate the imaging line 20 forming the raster of exposed lines making up the latent image on the photoreceptor surface.

In the operation of the system 10, as thus far described, the processor 32 generates an accurately timed data bit stream to expose each raster line 22 according to successive line segments of the composite image. In xerographic color systems, four color separation images must be generated, one for each of the three basic colors and black. A multi-pass system such as the system 10 with one ROS requires four revolutions of the belt 12 to complete the four color separation exposures. As is known in the art, a single pass system exposes each image area successively by using four imaging lines provided, for example, by four independent laser ROS scanners. Continuing with the description of FIG. 1, raster lines 22 of the latent image are sequentially exposed at imaging line 20 as a result of the longitudinal movement of belt 12. The exposure of each image area must be precisely positioned so that the color separations will properly register in the composite color print.

It is to be noted that the length of the exposed raster lines 22 can be designed to be slightly shorter than the useful scan line length. Thus, the latent image exposure of each scan line may be shifted in a transverse direction simply by advancing or delaying the phase of the data bit stream controlling the modulation pattern of the laser under control of the laser drive module 30. This results in a transverse repositioning of the exposed raster lines 22, and the image area is seen to shift laterally in relation to the edge of the belt 12. Further, the exposure of a sequence of lines 22 can be advanced or delayed by any number of whole lines e.g., re-indexing the location of each line 22 of the raster sequence in the process direction.

In accordance with the present invention, signals indicating progression of the perforations in the non-image areas are generated and used to precisely position successive latent image exposures. This operation is achieved by use of a fiber optic detection system 36. A plurality of apertures, perforations, or transparent windows 37, 38, 39 are formed along the edge of the belt 12 aligned in a longitudinal (process) direction and located at the upstream or leading edge of each image area in the context of belt travel.

Figure 2:
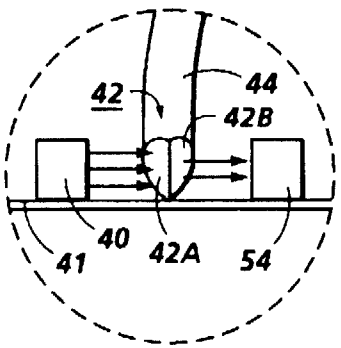
FIG. 2 is an enlarged view of one end of the optical fiber shown in FIG. 1.
Figure 3:
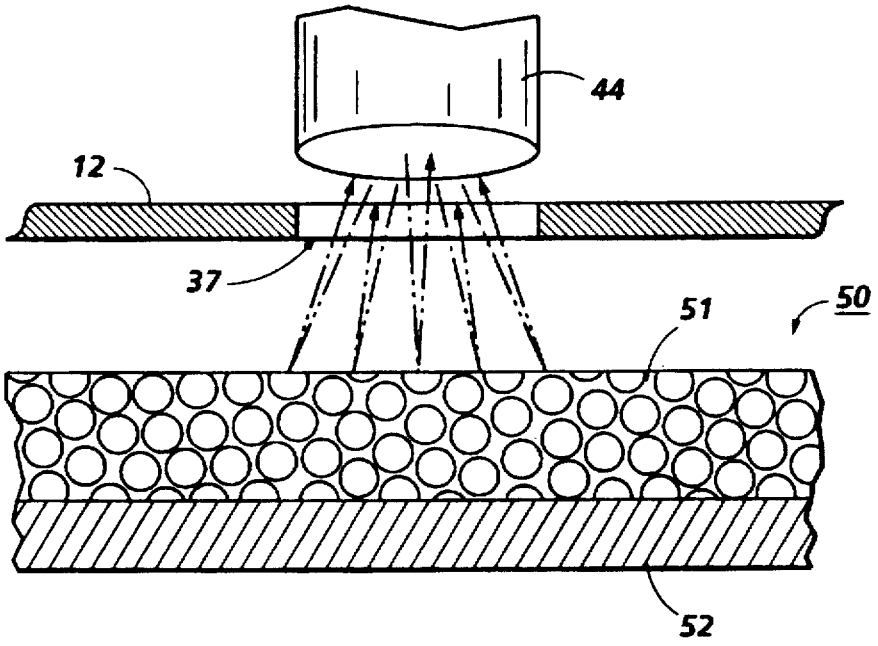
FIG. 3 is a partial side view of a portion of the belt of FIG. 1 illustrating the light transmitted from the exit end of the fiber onto a rectroflective member through a belt hole.

Continuing with the description of FIG. 1, and referring additionally to FIG. 2, a light source 40 on the central electronics circuit board 41 in the form of an incandescent or phosphorescent lamp, LED, or a laser diode device, is positioned so that its luminous flux is coupled into the input end 42 of optical fiber 44. Fiber 44 is preferably a plastic. Input end 42 is formed into two optical surfaces 42A, 42B. Light is coupled into surface 42A and propagates to the output end of the fiber, while retroreflected light returning in the fiber emerges in part from surface 42B and is used for detection purposes as will be seen. Light propagates along the fiber length by internal reflection, and flux is emitted from the output end of the fiber in the form of a cone of light that illuminates area 46 on the belt that is in the direct path of apertures 37, 38, 39. As the belt moves in the process direction, indicated by arrow 18, aperture 37 moves into illuminated area 46 allowing flux to pass through the belt. As shown in FIG. 3, the light passes through aperture 37 and is reflected in a preferential direction by retroreflector 50. Retroreflector 50 comprises reflecting surface 51 affixed to a stationary substrate 52 in line with the longitudinal path of travel of holes 37, 38, 39. Retroreflecting surface 51, in one embodiment, comprises microscopic glass beads with a diameter of about 0.1 millimeter and with a refractive index of about 1.9. The beads are preferentially embedded in a highly scattering matrix such as titanium oxide. Further details regarding this embodiment are described for example in Physics Education 1991, pp. 245, 246 by Neil Morton, the disclosure of which is hereby incorporated by reference. Suitable retroreflecting glass spheres are also available from Potters Industries, Carlstadt, NJ. "Visibeads" from Potters Industries are engineered for epoxy, latex paint, polyester, and thermoplastic binders. Particularly useful are the T-4 high index glass beads with a size range of 90 to 53 microns. A line of retroreflecting liquids is also available from 3M, St. Paul, Minn, under the trade name "Scotchlite, Series 7200". These retroreflecting liquids are available in several colors and can be applied by screen printing, brushing, spraying, and dipping. These retroreflecting materials are also available from 3M coated on film under the trade name "Trimlite". In addition, retroreflecting particles can be prepared by forming small droplets of molten glass having a relatively high index of refraction, followed by cooling to form solid spheres. Ideally, the index of refraction for the glass employed is 2. The index of refraction can be as low as 1.5, but values closer to 2 are preferred. Materials with indices of refraction greater than 2 can also be employed if desired, although no additional advantages are realized by exceeding an index of refraction of 2. Submicron-sized particles can be prepared by heating air fluidized glass powder. The retroreflective filler is present in the marking material in any effective amount.

Referring still to FIG. 3, the properties of retroreflecting surface 51 reside in the reflected light returning along the same path as the incident beams (colinear with the direction of illumination). The output end of fiber 44 resembles a point source over a limited angle. Retroreflecting surface 51 acts collectively at every point on its surface, reflecting the incident flux back through the aperture 37 toward the source, with the net effect that the returned flux from the divergent source is concentrated at the point from which it was emitted. (The beaded surface acts like a spherical mirror centered at the source but without the need for alignment.) Since an appreciable fraction of the light delivered by the fiber is returned to the fiber without the need for lenses or alignment, beaded patches on or behind the belt surface greatly improve light collection efficiency over ordinary white Lambertian surfaces and yield proportionately strong optical signals. Further, because of its special optical characteristics, the retroreflecting surface 51 need not be oriented normal to the principle incident light rays; angles from 0° to more than 60° from normal are suitable for illuminating and detecting reflected light with minimum loss in efficiency.

This retroreflected light can therefore be used for detection purposes, the collected fraction returning through the same fiber 44, with approximately half the returned light emerging from output surface 42B and falling incident on photosensor 54. The output of sensor 54 is amplified and compared with reference signals as is known from U.S. Pat. No. 5,321,434, whose contents are hereby incorporated by reference, and process direction registration correction signals are generated and used to adjust the phasing of the data streams controlling the ROS exposure; e.g. to adjust the transverse and process direction position of the latent images in scan lines 22.

Figure 4:
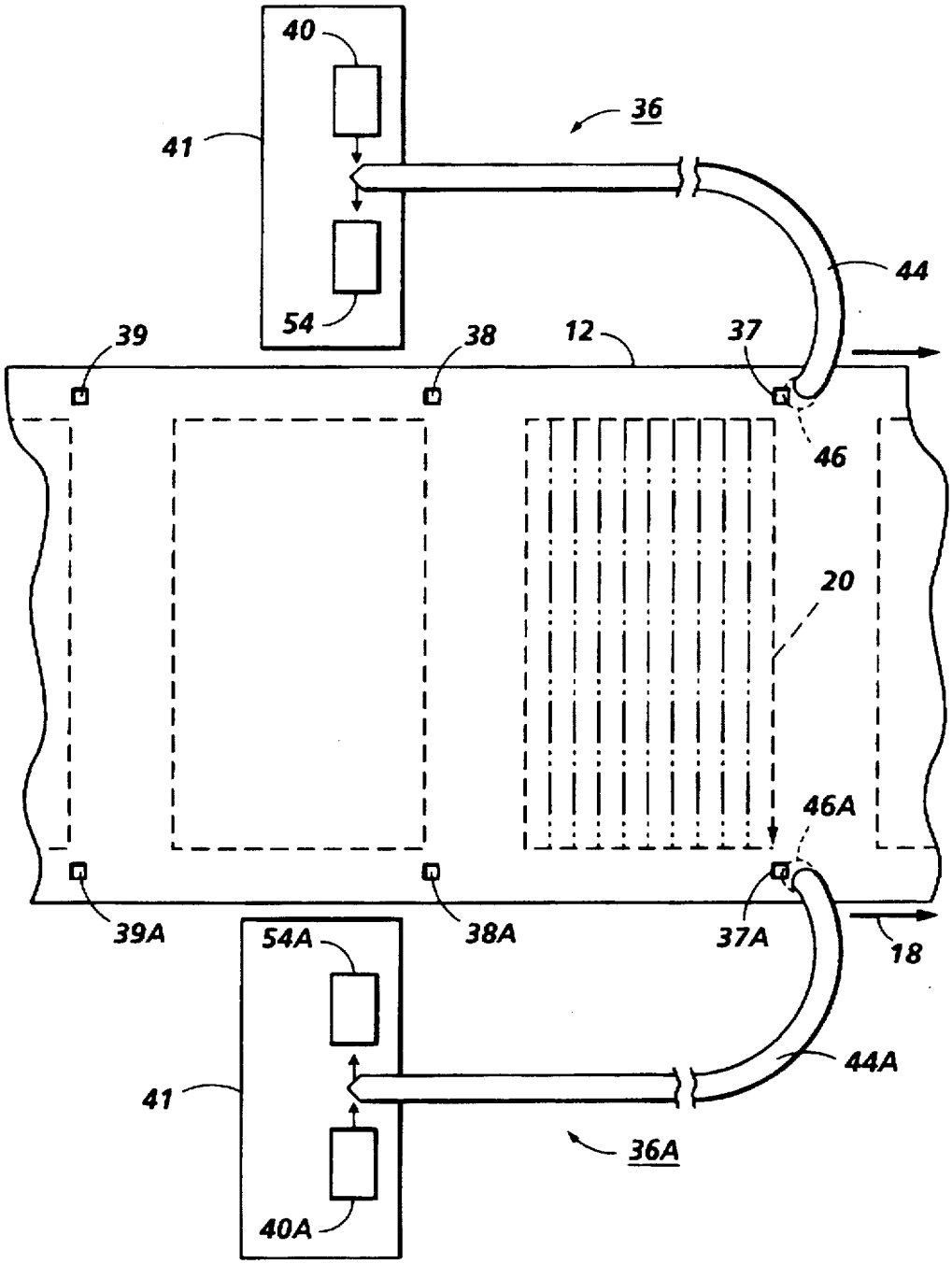
FIG. 4 is another embodiment of the invention illustrating the use of two optical fibers at opposite sides of a photoreceptor belt to transmit registration signals to separate photosensors.

Skew misregistration of the belt requires formation of an aperture pair, the second aperture 37A (FIG. 4) being located at the other edge of the belt directly opposite aperture 37 in the transverse direction. A second optical fiber 44A is positioned as shown to provide a second illuminated area 46A. This fiber 44A has the same characteristics as fiber 44, is illuminated by the same type of light source 40A and has a second detector 54A on the same central electronic system circuit board 41. Belt 12 is moved until apertures 37, 37A pass into the illuminated areas 46, 46A, respectively. Light is retroreflected from retroreflector 50 and a second associated retroreflector (not shown but similar in construction and mounting to retroreflector 50), the collected light returning through fibers 44, 44A to detectors 54, 54A. The resulting responses are amplified and sent to a timing comparison circuit which generates appropriate signals for adjusting the skew orientation of the scan lines. Circuitry to accomplish this type of correction are known in the art for example in U.S. Pat. No. 5,302,973 and co-pending application Ser. No. 07/946,703 whose contents are hereby incorporated by reference. It is understood that the invention resides in the manner in which the registration correction signals are generated e.g. in the bidirectional transmission of light through an optical fiber or fibers to both illuminate a retroreflective target and to transmit the retroreflected light so as to stimulate a photosensor.

Figure 5:
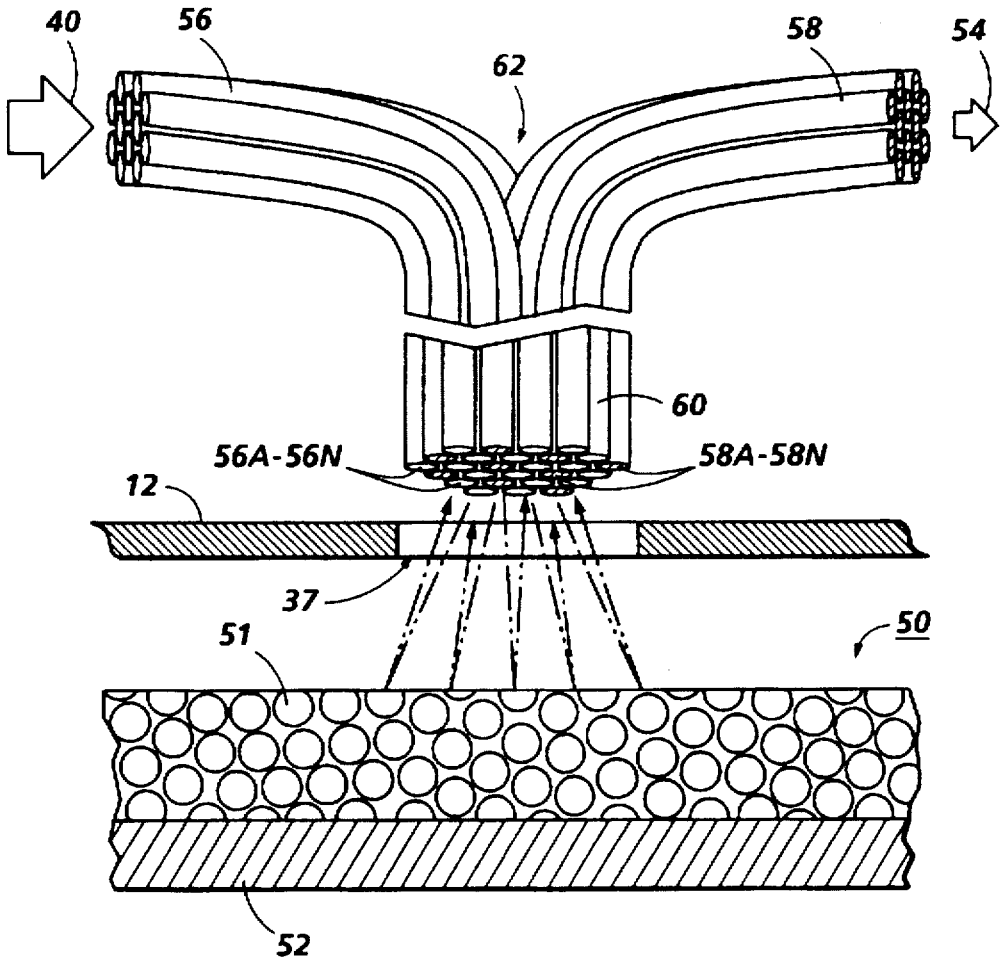
FIG. 5 and FIG. 6 show a second embodiment of the optical fiber shown in FIG. 1.
Figure 6:
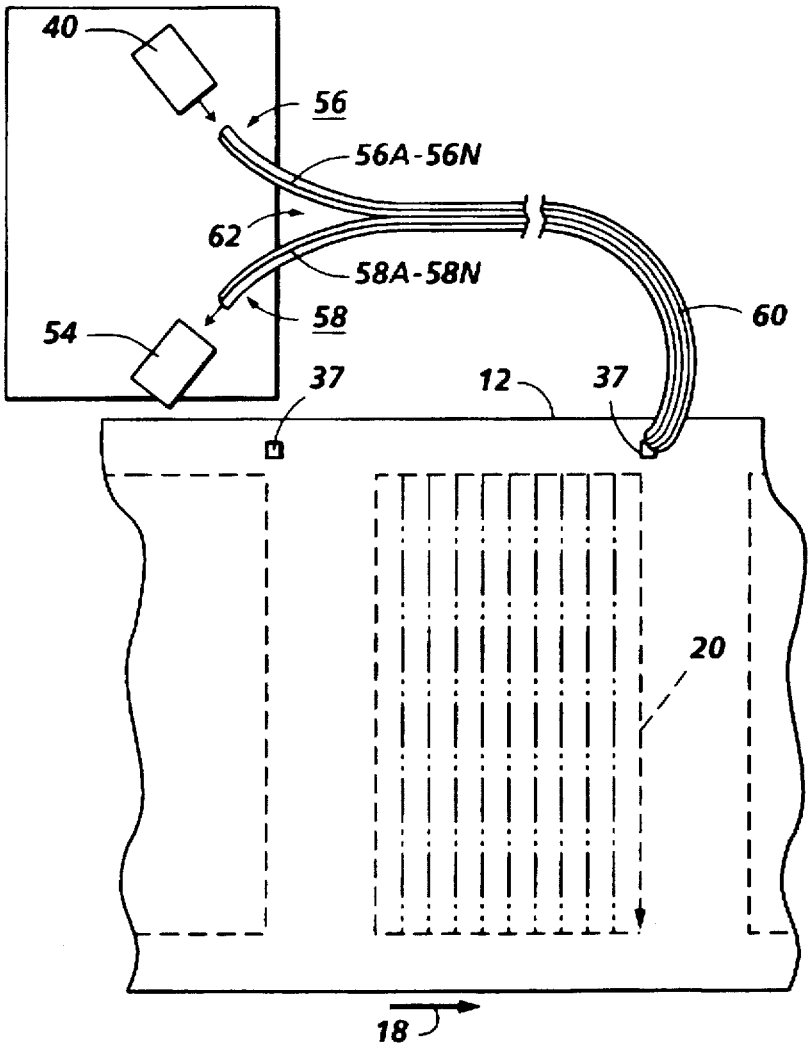

In the embodiment shown in FIG. 1, a single fiber 44 is used in a first mode to bring an illuminating flux to a belt hole (lighting mode) and, in a second mode to bring retroreflected light back through the fiber to a sensor (detector mode). In another embodiment shown in FIGS. 5 and 6, a plurality of fibers 56A–56N are bundled together to form an input branch fiber assembly 56. Another plurality of fibers 58A–58N are bundled together to form an output detecting branch fiber assembly 58. The belt hole ends of the fiber are bundled and intertwined together as shown to form an fiber optic trunk 60. Light is emitted from trunk 60 through the ends of all of the fibers 56A, 56N. Retroflected light is transmitted back through trunk 60 up to junction 62 where the light is split with up to one half of the retroreflected light being available for illuminating sensor 54. Preferably the bundled fibers at the trunk 60 can be softened and compressed to increase compactness and improve collection efficiency.

While the improved detecting system of the present invention has been described in the context of detection of light flux retroreflected through a hole or apertures formed in the photoreceptive belt, the invention can also be enabled by using retroreflective targets formed directly on the belt and located where the holes would be formed. For example, in the embodiment in FIG. 4 instead of apertures 37–39 and 37A –39A through the belt, the holes would be replaced by retroreflecting patches formed on the belt surface. These patches may be formed by coating, spraying or any of the ways disclosed in co-pending U.S. application Ser. No. 07/161,619 whose contents are hereby incorporated by reference. The principle of detection is the same as for the FIG. 1 to 3 embodiments; the fibers in either configuration emit light flux in a cone to cover areas 46, 46A. The retroreflective target acts collectively to reflect the flux back through fibers 44, 44A. This embodiment is useful in drum type photoreceptors where apertures cannot be formed through the drum surface. The advantage of forming the retroreflector on the belt surface is that it eliminates potential belt stresses and fractures associated with cutting actual perforations in the belt. The disadvantage is that a retroreflective coating on the belt surface would be cycled through the various xerographic process steps such as development and cleaning, and further, there is a need for additional processing of the belt to add the patches which must be carefully positioned and defined.

While the embodiments disclosed herein are preferred, it will be appreciated from this teaching that various alternative modifications, variations or improvements therein may be made by those skilled in the art. For example, clear tape may be bonded over belt perforations 37, 38, 39 in FIG. 1 to exclude dirt. These and other embodiments are intended to be encompassed by the following claims:

I claim:

1. In a color reproduction device which includes a photoreceptor moving along a process path, an imager for forming a plurality of superimposed color-separated latent images on said photoreceptor in accord with input image data and a fiber optic detection system for providing timing signals used to register said latent images, said fiber optic detection system including:

a light source, an optical fiber having an input end optically coupled to said light source and an output end positioned so as to emit a light flux, the optical fiber positioned with respect to the photoreceptor so that the light flux emitted from the output end illuminates an area of the photoreceptor outside said latent images, a retroreflector target positioned so as to be periodically illuminated by said light flux emitted from said output end and a photosensor optically coupled to said input end wherein said target, when illuminated, reflects light in a preferential direction back into the output end of the optical fiber, a portion of said reflected light propagating along the optical fiber to illuminate said photosensor to provide an output registration signal therefrom.

2. The apparatus of claim 1 further including a registration correction circuit responsive to the output registration signal to register said superimposed latent images.

3. The apparatus of claim 1 wherein said photoreceptor is a photoreceptor belt and said retroreflector target is a retroreflecting material formed on the photoreceptor.

4. The apparatus of claim 1 wherein said photoreceptor is a photoreceptor belt having at least one transparent portion and wherein said retroreflector target is positioned beneath the photoreceptor belt in a location wherein the retroreflector target is periodically illuminated through said transparent portion.

5. The apparatus of claim 1 wherein said photoreceptor is a photoreceptor drum and wherein said retroreflector target is formed on the photoreceptor.

6. In an imaging device having a photoreceptor belt with an image supporting surface moving along an endless path in a process direction and an imager for forming images on the image supporting surface, means for maintaining image registration comprising:

retroreflective registration marks formed on the belt in an non-image area, fiber optic means for transmitting light directed into an input end of said fiber optic means onto said photoreceptor belt from an output end to periodically illuminate said registration mark, said fiber optic means transmitting light reflected from said mark back to said input end and photosensor means optically coupled to said reflected light at said input end for generating registration signals to enable image registration of images on the belt.

7. A fiber optic light detector comprising:

a light source, a retroreflective target moving along a predetermined path, a photosensor, and fiber optic means for coupling light from said light source onto said retroreflective target and for transmitting a portion of light retroreflected from said target to said photosensor.

8. A process for determining a relative position of a movable component in an imaging apparatus which comprises (a) providing on the movable component at least one mark with a marking material containing a retroreflective material; (b) positioning an illumination source so that illumination from the illumination source striking the mark on the movable component is detected through an optical fiber; (c) positioning an illumination detector so that it can detect illumination reflected from the retroreflective material on the movable component and transmitted back through said optical fiber ; and (d) calculating the relative position of the movable component using information provided from the illumination detector.

* * * * *